US007073695B1

(12) United States Patent
Haselwander

(10) Patent No.: US 7,073,695 B1
(45) Date of Patent: Jul. 11, 2006

(54) MULTI-END STRAND PREDETERMINED TENSION CONTROLLER

(75) Inventor: John G. Haselwander, Chattanooga, TN (US)

(73) Assignee: Manufacturing Designs & Solutions, Inc., Chattanooga, TN (US)

( * ) Notice: Subject to any disclaimer, the term of this patent is extended or adjusted under 35 U.S.C. 154(b) by 0 days.

(21) Appl. No.: 11/033,584

(22) Filed: Jan. 12, 2005

(51) Int. Cl.
*B65H 23/16* (2006.01)

(52) U.S. Cl. ..... 226/34; 226/39; 226/110; 242/418.1

(58) Field of Classification Search ..... 226/34, 226/35, 39, 110, 118.2, 155; 242/154, 417.3, 242/418.1, 419.7
See application file for complete search history.

(56) References Cited

U.S. PATENT DOCUMENTS 4,162,607 A * 7/1979 Spivey ..... 57/287
4,778,118 A * 10/1988 Niederer ..... 424/364.11
4,858,839 A * 8/1989 Niederer ..... 242/364.11
5,928,579 A * 7/1999 Spahlinger et al. ..... 264/40.1

* cited by examiner

*Primary Examiner*—Kathy Matecki
*Assistant Examiner*—William E. Dondero
(74) *Attorney, Agent, or Firm*—Stephen J. Stark; Miller & Martin PLLC

(57) ABSTRACT

A multi-end strand tension controller has an overfeed roll and an underfeed roll with strand engagement surfaces. Depending on the outgoing tension, the strand positioner selectively apply the strand against one of the underfeed rollers to adjust the tension and the output of the tension controller. The underfeed roller is fed at a speed slower than the speed of the strand while the overfeed roller is fed at a speed greater than the speed of the feed of the strand. Multiple strands forming the web can be provided utilizing a controller and different predetermined tensions may be applied to each of the individual strands based upon loading of individual strand positioners.

20 Claims, 3 Drawing Sheets

MULTI-END STRAND PREDETERMINED TENSION CONTROLLER

FIELD OF THE INVENTION

The present invention relates to an apparatus which equalizes tension (i.e., reduces tension in over tension yarn while increasing tension in loose yarn), among a web of a multiplicity of strands, and more particularly to an apparatus designed to overfeed tighter strands and simultaneously underfeed loose strands in order to provide strands with each strand having a predetermined desired tension to a downstream apparatus.

DETAILED DESCRIPTION OF RELATED ART

Many industry segments utilize multiple strands of elongated elements in various processes. In some processes, multiple strands are preferably fed at a substantially uniform tension to reduce or prevent unwanted effects. Various industries including the carpet industry, textile industry, tire cord industry, and others have processes where multiple strands are preferably fed at substantially the same tension. In fact, some problems can occur when particular strands in a web are at a significantly higher tension than others.

In the carpet industry, a tufting machine is generally utilized to tuft yarn into a backing to produce carpet having pile extending from a surface. The tufting machine generally has a multiplicity of needles, each fed with a strand of yarn. The yarn strands are typically fed to the tufting machine from a creel. When fed from a creel, some of the yarn strands are closer to the tufting machine than others. Other yarn strands travel through a more tortuous path than others. Accordingly, the resistance to movement is greater among some strands than others.

When yarn strands are fed to a tufting machine, those which have a higher resistance typically exhibit a higher tension than some others. Additionally, resistance may vary at different times on strands for many different reasons. When a higher tension yarn is run through the tufting machine, undesired effects could include the tufting of loops which are not the same height as those from "looser" yarn ends. If one were attempting to tuft a particular level over a section of carpet, the presence of a higher or a lower loop could be noticeable and cause the carpet product to be rejected. In cut pile carpets such an effect could require excessive tip shearing. Accordingly a need exists to equalize tension across multiple yarn ends.

The typical approach in the carpet industry has been to try to control tension in the individual strands which are slack, or exhibit a low tension. Many patents are believed to be directed to devices which apply tension to lower tension yarn strands. For instance U.S. Pat. No. 908,255 shows a braking system which increases tension on lower tension strands.

Other tension control devices utilize two successive wheels where yarn is completely wrapped around both wheels. U.S. Pat. No. 5,957,359 provides yarn to a first wheel which the yarns then pass. The first wheel "supplies more length of fibre to the space between the wheels" than which passes over the second wheel (Col. 3, lines 25–35). Thus, all the tensions are raised at the first wheel, and then lowered between the first and second wheel due to the slightly slower speed of the second wheel. If the tension is already too low on a particular fibre, too much alack could be created, especially if it sticks to the first roller. Entanglement with the other yarns could easily occur in such event.

U.S. Pat. No. 4,087,956 appears to have somewhat similar double roll wrapped structure.

U.S. Pat. No. 4,513,792 shows a weft yarn tensioning device which selectively picks yarn for the placement of additional tension on selected yarns. However, if any of the yarns are tighter than desired, there does not appear to be a way to loosen the tension on selected yarn strands. The applicant has also recently obtained U.S. Pat. No. 6,776,319 which relates to overfeeding strands which exceed a predetermined tension to loosen those strands with an overfeed roll. While the applicant's device shown and described in the '319 patent is a significant improvement over the prior art, if a strand become loose and continues to get looser and looser, this problem cannot be corrected by this prior art device.

Efforts to individually control the tension on individual strands of yarn appear to be addressed with variable speed motors on separate threads as provided by U.S. Pat. Nos. 4,662,407, 5,657,941 and 5,950,955. Other attempts include U.S. Pat. No. 6,240,974 which discloses an apparatus for use with a catch selvage yarn weaving loom which provides tension to a supply spool through a braking action. This device appears to treat all the yarns driven by a spool together and does not appear to provide for individual yarn tension control.

Accordingly, there remains a need for a simple and effective yarn tension controller which can address both over tension and under tension situations or individual yarn ends.

SUMMARY OF THE INVENTION

Consequently, it is an object of the present invention to provide a tension controller configured to provide a predetermined tension respectively on each of a plurality of multiple strands fed as a web.

It is a further object of the invention to utilize an overfeed roll and an underfeed roll to create slack or tension on strands based upon the pre-determined settings for each of the strands.

It is another object of the present invention to utilize gravity to assist with an overfeed and underfeed roll to equalize tension across multiple strands.

It is another object of the present invention to provide an overfeed roll together with an underfeed roll wherein the strands under tension are selectively applied in contact one of an overfeed and an underfeed roll depending upon the input tension desired output tension on the strands.

Accordingly, in a preferred embodiment, an overfeed roll and an underfeed roll are positioned laterally to the direction of feeding multiple strands and parallel. The strands are fed through respective brackets which each direct their yarn strands past the rollers. The underfeed roller is located further downstream in the direction of feed than the overfeed roller and bracket assists in moving the yarn strand to contact the underfeed roller in the event of a low tension situation (i.e., tension less than a predetermined amount) and the overfeed roller in the event of a high tension situation (i.e., greater than a predetermined amount). The brackets may be loaded or biased so that they provide a predetermined loading of tension to each of the strands. Different strands may be loaded with different predetermined loadings depending on the particular application.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
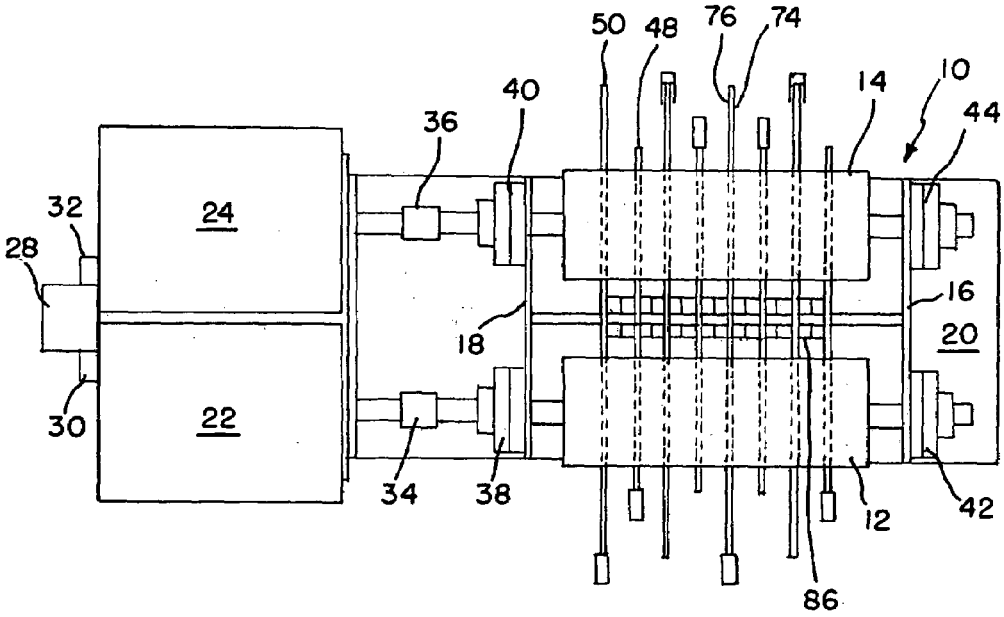
FIG. 1 shows a bottom view of a portion of the tension controller 10 of the presently preferred embodiment with strands, weight devices and every other frame, removed for ease in viewing the remaining portions.

FIG. 1 shows a bottom view of a tension controller 10. Underfeed roller or slower roller 12 is preferably parallel to overfeed or over speed roller 14 with the rollers 12,14 supported by supports 16,18 from a platform 20. The embodiment of the platform 20 is illustrated located above the rollers 12,14. In other embodiments, the platform 20 can be located below the rollers 12,14 or otherwise. Furthermore, a plurality of platforms 20 or other structures could be utilized to support the rollers 12,14.

The rollers 12,14 are illustrated operably coupled or connected to motors 22,24. The motors are preferably variable speed motors. The motor 24 preferably drives the over feed roller 14 at a speed faster than the speed of supply of strand 26 so that the surface of the roller 14 is traveling at a speed faster than the speed of the strand 26 or strands 26 which are fed to a downstream machine (not shown). The downstream machine could be a tufting machine or a warper, or other appropriate machinery. It is preferable that the length of the rollers 12,14 be long enough to accommodate all the strands 26 utilized on a downstream machine; however, one or more controllers 10 could be utilized depending upon the particular application.

Figure 3:
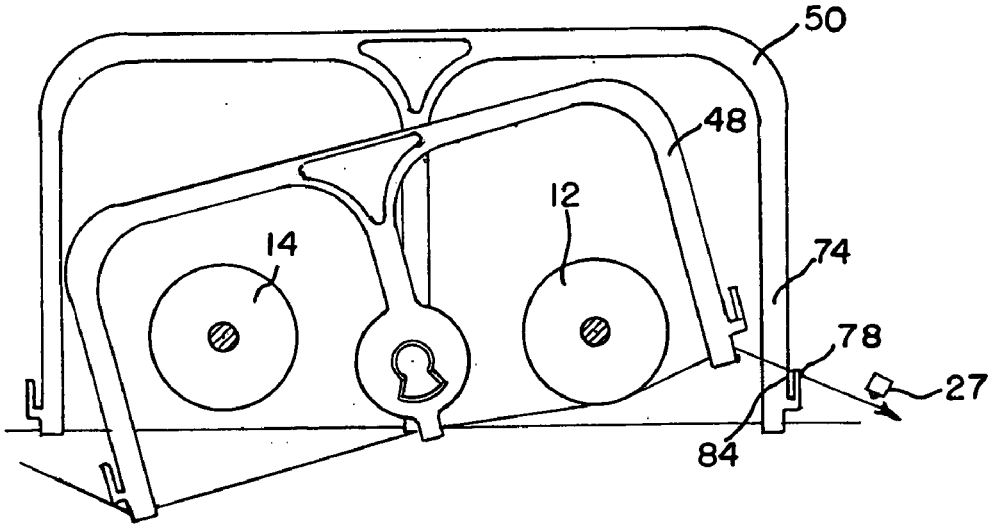
FIG. 3 shows a cross-sectional view taken along line A—A in FIG. 2 with strands attached.

Strands 26 as they are fed onto a downstream machine may be sensed for a speed and/or tension by a sensor such as a sensor in connection with an encoder or other device. Speed sensor 27 is illustrated in FIG. 3. Speed information can then be provided to a controller 28 which can then provide signals through inverters 30,32 to the motors 22,24 to provide a desired speed of rollers 12,14. It is anticipated that through the use of a controller 28, that the engagement surface speed of the over speed roller 14 can track the speed of the strand 26 to but strand engagement surface of the over speed roller 14 can maintain a speed faster than the speed of the strand 26.

Underfeed roller 12 is also illustrated preferably driven by a variable speed motor 22. The surface speed of the underfeed roller 12 is preferably slower than the speed of the strand 26 such as yarn, fiber, wire, etc. The length of the underfeed roller 12 is also preferably long enough to contact the multiple strands 26 proceeding to the downstream machine like the overfeed roller 14. In some embodiments, it may be possible that the motor 22 can drive the underfeed roller 12 in an opposite direction to the direction of feed of the strands 26. It is anticipated that the strand engagement surface speed of the underfeed roller 12 will track the speed of the strand 26, but will be slower than the speed of the strand 26.

Flexible couplings 34,36 are useful to join the motors 22,24 to the rollers. Bearings 38,40,42,44 are useful to support the rollers 12,14 relative to the support 16,18.

Figure 2:
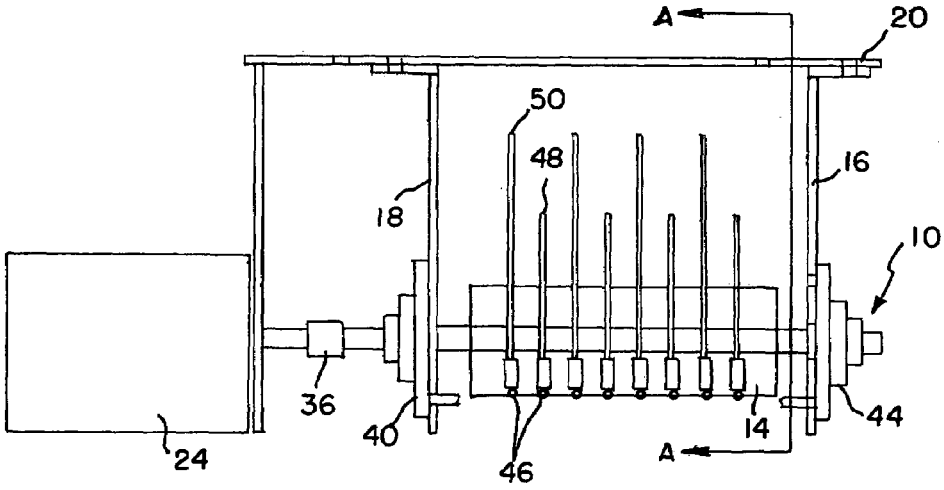
FIG. 2 shows a side view of a tension controller 10 shown in FIG. 1.

FIG. 2 is useful in that it shows guides 46 which allow for the yarn to pass through and assist in directing the yarn relative to the laterally oriented rollers 12,14. Depending on the tension on the strand 26, the strand 26 can contact at least one of the rollers 12,14 selectively at least at times, and may possibly contact both of the rollers 12,14 for brief intervals.

Figure 7:
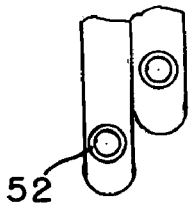
FIG. 7 shows an end view of a portion of the brackets shown in FIG. 3.

FIG. 3 shows one technique of reducing the gauge (i.e., the spacing of adjacent strands 26) as they are fed through the tension controller 10. First and second brackets 48,50 or strand positioners can be employed by utilizing two different shaped brackets 48,50 which do not contact one another as they rotate through their operating ranges thereby allowing the gauge to be smaller (i.e., the strands 26 can be closer together, thereby through this technique) than a width of the brackets 48,50. As seen in FIG. 7, the strands 26 proceed through the inner diameter of guides 52. Guides 52 when used with fabric or yarn strands 26 may be ceramic. Brackets 48,50 may be constructed of a metal. The metal surrounding the guides 52 may extend around the outer diameter of the guides 52 as well as the inner diameter of the guides 52 whereas the strands 26 typically have a diameter less than the inner diameter. Accordingly, in order to reduce the gauge to less than the width of the brackets 48,50 as shown in FIG. 7, then staggering of adjacent first and second brackets 48,50 as shown in FIG. 3 has been found helpful since the brackets can be staggered at a gauge slightly larger than the width of the strands 26 themselves.

Figure 4C:
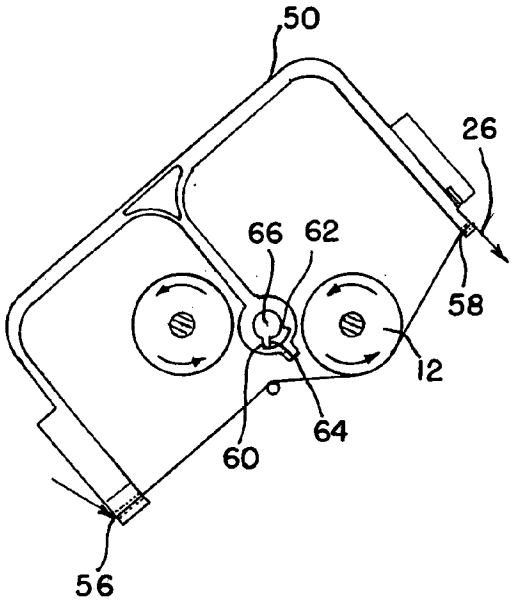
FIGS. 4A–4C show a portion the apparatus in operation as it relates to a single strand.
Figure 4B:
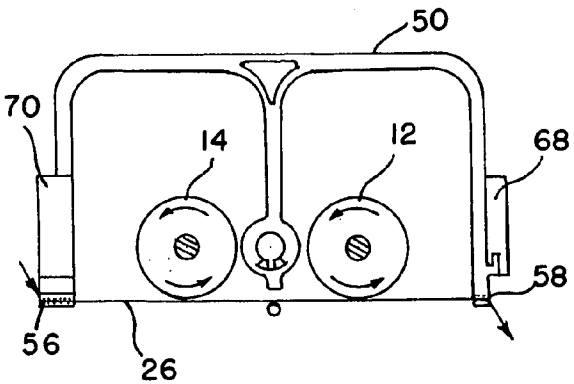
Figure 4A:
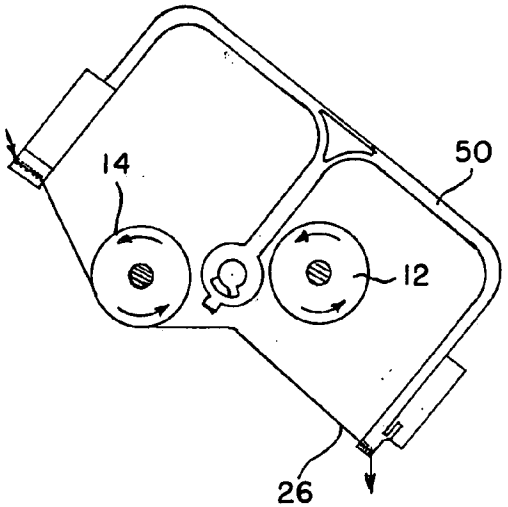

Referring to FIGS. 4A–4C, the operation of each of the individual brackets 48,50 may be illustrated. Underfeed roller 12, as explained above, is has a strand engagement surface speed slower than the speed of feed of the strand 26. A strand engagement surface of overfeed roll 14 (i.e., exterior surface in the preferred embodiment) is provided at a speed greater than the speed of yarn feed 26. If the tension on the strand 26 exceeds a predetermined amount of tension, bracket 50 rotates which places the strand 26 against the strand engagement surface overfeed roller 14 as shown in FIG. 4A and not in contact with strand engagement surface of underfeed roller 12. Since the strand engagement surface speed of the overfeed roller 14 is greater than the speed of travel of the strand 26 the tension on the strand 26 will be loosened thereby reducing the overtension situation. As the tension is brought back to the predetermined level or range, then the strand 26 and the bracket 50 can return to the position shown in FIG. 4B. Accordingly, the bracket 50 selectively applies the strand 26 to the overfeed roller 14 to reduce tension.

It may be that either both of the strand engagement surfaces of the rollers 12,14 or neither of the rollers 12,14 are contacted, when the desired predetermined tension is provided into the first yarn guide 56 and out the second yarn guide 58. The first yarn guide 56 acts as the controller input in the preferred embodiment while the second yarn guide 58 acts as the controller output. At least a portion of the rollers 12,14 is located the yarn guides 56,58 as illustrated. The strand 26 is illustrated contacting both of the rollers 12,14 in FIG. 4B but one skilled in the art would understand that if the rollers 12,14 were elevated relative to the guides 56,58 so that they did not touch as shown in FIG. 4B, this could be done relatively easily in some embodiments just by how the position of the rollers 12,14 are selected relative to the brackets 50.

FIG. 4C shows an undertension situation where the tension on the strand 26 is less than the predetermined tension. When the bracket 50 rotates as shown it places the strand 26 solely against the yarn feed roller 12 which has a strand engagement surface moving at a slower speed than the strand 26 possibly, even in an opposite direction than the direction of feed 26 as shown. This selectively adds tension. When the speed of the underfeed roll 12 and thus the strand engagement surface is maintained by the controller 28, the desired output tension on the strand 26 through the second yarn guide 58 can be maintained at a predetermined tension.

When the underfeed roller 12 is utilized to contact multiple strands 26 at the same time then the roller 12 can be utilized through the controller 28 to provide for the highest tension situation which will cause range of the lower tension strands 26 to come towards the predetermined tension quicker thereby resulting their brackets 50 rotating back toward the position shown in FIG. 4B (or even 4A) quicker. In order to prevent the brackets 50 from experiencing too great of a differential in tension from a particular strand 26, stops 60,62 engaged by finger 64 connected to pivot shaft 66 has been found to be useful. An operating range can then be established. As shown in FIGS. 4A and 4C, the bracket 50 reaches its furthest arc of rotation clockwise or rotation angle and counterclockwise respectively in the preferred embodiment. When finger 64 encounters respective stop 60 or 62. The use of the stop 60,62 of the finger 64 has been found helpful to prevent excessive differentials and tension which might otherwise cause the bracket 50 to be jerked into a compromising situation.

Figure 5:
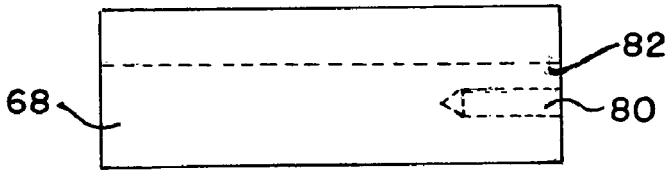
FIG. 5 shows a weight device as shown in FIG. 4 from a side view.
Figure 6:
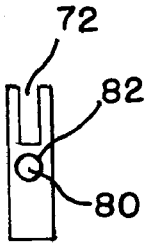
FIG. 6 shows the weight device of FIGS. 4A–4C and 5 from a bottom view.

In order to set the predetermined tension on a particular strand 26, biasing means such as tension adjusters 68,70 such as weights, biasing means such as a spring or other mechanisms 68,70 could be utilized to adjust the predetermined tension on a strand 26 as it leaves the guide 58 and is fed towards the downstream machine (not shown). As shown in the preferred embodiment the tension adjustors 68,70 may be made of any particular material. The applicant has found that when a sleeve type construction as shown in FIGS. 5 and 6 is utilized, a channel 72 engages the side 74 of the bracket 50 (opposing side not shown but illustrated as 76 in FIG. 1). The tension adjustment 68 may be placed about the sides 74,76 with the channel 72 engaging the side 74,76 and then slid down so that the foot 78 engages the bore 80 which entraps shelf 82 located between the channel 72 and the bore 80 between the foot 78 and the leg 84 supporting the foot 78 as shown in FIGS. 3, 5, 6 and FIGS. 4A–4C. The tension adjustor 68,70 could then be rapidly replaced with another adjustor 68,70 to change the predetermined tension applied to strand 26.

It is important to remember that strands can be all types of yarn, thread, steel wire or other strands in which controlling the tension is deemed to be advantageous or desired. Unlike prior art devices which have been utilized to reduce tension on overtension strands, or provide individual servo motors for each of the strands, applicant's device is believed to be a cost-effective way of addressing tension on multiple strands in an economical manner. Through the use of applicant's preferred embodiment, the device can be used to equalize the tension on the strands 26 as they exit the second guide 58 or other outlet so that multiple yarns or other strands 26 can be fed to downstream processes such as warping, tufting and continuous space dyeing, continuous heat setting, twisting or entanglement or other processes.

The actual speed of the rollers 12,14 and their corresponding strand engagement surfaces can be adjusted in relation to the speed of the yarn 12 as sensed by a downstream encoder with sensor 27 or other device. This allows for the ability to adjust the desired over or under speed to provide the desired tension to the strand 26 as it leaves the second guide 58 or other location. An example of the use of the tension controller 10 is described below.

Suppose the preload of the tension controller 10 is set at 30 grams. Suppose also that the tension entering the first guide 56 of the particular bracket 50 is measured at 30 grams. The bracket 50 of the tension controller 10 (would be represented by FIG. 4B. Tension at the guide 58 can be 30 grams especially if the amount of the overspeed roller 14 and the underfeed roller 12 are symmetrical set with respect to the speed of the strand 26.

If the tension controller 10 is set at 30 grams and the tension device through the first guide 56 changes to 10 grams, the bracket 50 would rotate as shown in FIG. 4C so that the contact is made with the underfeed roller 12 which is moving slower than the speed of the yarn of the strand 26 thereby increasing the tension through the tension controller 10 so the output tension from the second guide 58 is 30 grams. This can continue until the input tension increases to around 30 grams so that the bracket 50 rotates back to the position in FIG. 4B. The amount of tilt of the bracket is believed to increase and vary depending on the tension entering the first guide 56 and the desired tension exiting the second guide 58 (i.e., a small tension differential may result in a relatively small angular rotation of the bracket 50, while a larger differential may result in a greater angular relationship).

FIG. 4A shows an example when the tension controller 10 is set having an exit tension on the strand 26 of 30 grams and tension is measured as greater than 30 grams, such as 50 grams. The bracket 50 rotates so that the overfeed roller 14 contacts a strand 26 while the under feed roller 12 does not contact the strand 26 thereby providing more yarn to decrease the tension as the yarn leaves the second guide 58 until tension is back to 30 grams exiting the second guide 58, such as represented by FIG. 4A.

The bracket 50 may preferably about ⅛" thick although its thickness may vary. The staggering technique as shown in FIG. 7 can be utilized to decrease the gauge of the tension controller 10. It should be obvious to one skilled in the art that almost any gauge can be provided. If the brackets 50 are constructed so that the portions surrounding the stops 60,62 and shaft 66 as equipped with bushings 86 that preferably extend beyond the side 74 of the bracket 54, the gauge can be set when used in conjunction with other bushings 86 of adjacent brackets 50 independent of the width of the brackets 50.

While it is anticipated that the weighting device 68,70 are normally placed on the overfeed roller 14 side of the bracket 50, it is also possible to place them on the underfeed roller 12 side to lower tension. Furthermore, in applications where incoming tension is expected to often be above a desired predetermined tension, devices such as the one shown in U.S. Pat. No. 6,776,319 or others can be utilized prior to feeding to the inlet (or first guide 56) of the tension controller 10.

While most devices such as tufting machines are configured to utilize a constant tension across multiple strands 26 comprising the web, the tension controller 10 has more flexibility than just providing a constant tension 26 across a web. Each of the individual brackets 50 may be weighted at a predetermined amount including to at least some different predetermined amounts. Accordingly, if a 2,000 denier and a 600 denier yarn strands are utilized, it may be possible to apply a smaller amount of weight on the 600 denier yarn than for the 2,000 denier yarn (i.e., a different predetermined amount of loading).

Additionally, in such processes such as air entanglement, it may be possible for three ends to be joined together to form one end. If a different color is utilized such as white, black, and beige for each of the strands, it may be possible to bury the black strand within the white and beige strands by providing more tension on the black strand than on the white and beige strands so that it is located on the inside of the entanglement. Other examples may include use on a warper where a small denier yarn is used in conjunction with a larger denier yarn and therefore the smaller denier could be provided with less tension than a larger denier of yarn.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A variable tension controller comprising:

a controller input and a controller output;

an underfeed roller, at least a portion of said underfeed roller located intermediate the controller input and the controller output;

a first strand positioner receiving a first strand from a controller input and directing the strand to a controller output;

an overfeed roller spaced from the underfeed roller, at least a portion of the overfeed roller located intermediate the controller input and the controller output, said overfeed roller having a speed at a strand engagement surface greater than a speed at a strand engagement surface of the underfeed roller;

the first strand positioner selectively placing the first strand in contact with the strand engagement surface of the underfeed roller and out of contact with the strand engagement surface of the overfeed roller when tension in the first strand drops below a first predetermined amount, and the first strand positioner selectively placing the first strand in contact with the strand engagement surface of the overfeed roller and out of contact with the strand engagement surface of the underfeed roller when the tension in the first strand exceeds a second predetermined amount.

2. The variable tension controller of claim 1 further comprising a plurality of first strand positioners directing respective first strands relative to the underfeed and overfeed rollers.

3. The variable tension controller of claim 1 further comprising a second strand positioner, said second strand positioner directing a second strand relative to the strand engagement surfaces of the overfeed and underfeed rollers along side the first strand, said second strand positioner and said first strand positioner having widths, and the widths of the first and second strand positioners when added together exceed the spacing of the first and second strands at a location intermediate the controller input and controller output.

4. The variable tension controller of claim 3 wherein the first strand positioner further comprises a first bracket, said first bracket rotatable about a first pivot through an operating range, and the second strand positioner further comprises a second bracket, said second bracket rotatable about a second pivot through an operating range, and the first and second brackets do not contact one another through their respective operating ranges.

5. The variable tension controller of claim 4 wherein the first and second strand positioners have bushings connected to the first and second brackets and positioned about the pivot, said bushings having a width; half the width of the bushings on the first and second strand positioners comprising a gauge of the tension controller intermediate the first and second strand positioners.

6. The variable tension controller of claim 1 wherein the first strand positioner further comprises a first bracket, said bracket rotatable about a pivot.

7. The variable tension controller of claim 6 wherein rotation of the first bracket in a first direction about the pivot to a first position places the first strand in contact with the strand engagement surface of the underfeed roller, and not in contact with the strand engagement surface of the overfeed roller, when the tension in the strand drops below the first predetermined amount.

8. The variable tension controller of claim 7 further comprising a first stop which limits the rotation in the first direction to a predetermined rotation angle.

9. The variable tension controller of claim 8 wherein the first stop is located within the first bracket and is contacted by a finger extending radially outwardly from a shaft extending through the pivot at the predetermined rotation angle.

10. The variable tension controller of claim 6 wherein rotation of the first bracket in a second direction about the pivot to a second position places the first strand in contact with the strand engagement surface of the overfeed roller and not in contact with the strand engagement surface of the underfeed roller when the tension in the strand exceeds the second predetermined amount.

11. The variable tension controller of claim 10 further comprising a second stop which limits the rotation in the second direction to a predetermined rotation angle and the second stop is located within the second bracket and is contacted by a finger extending radially outwardly from a shaft extending through the pivot at the predetermined rotation angle.

12. The variable tension controller of claim 10 wherein rotation of the first bracket in the first direction about the pivot to a first position places the first strand in contact with the strand engagement service of the underfeed roller, not in contact with the strand engagement surface of the overfeed roller, when the tension in the strand drops below the first predetermined amount; and when the strand contacts the strand engagement surfaces of both the overfeed and the underfeed rollers when tension in the strand is less than the second predetermined amount and greater than the first predetermined amount.

13. The variable tension controller of claim 1 wherein the first and second predetermined amounts are at least substantially equal.

14. The variable tension controller of claim 1 in combination with a sensor, and further comprising a controller coupled to the overfeed roller, wherein the first strand has a predetermined speed and is sensed by the sensor, and the strand engagement surface of the overfeed roller is driven based upon a signal from the controller to provide a speed at the strand engagement surface greater than the predetermined speed.

15. The variable tension controller of claim 14 wherein the controller provides a signal to drive a first variable speed motor coupled to the overfeed roller to drive the overfeed roller.

16. The variable tension controller of claim 14 wherein the underfeed roller is driven based upon a signal from the controller to provide a speed at the strand engagement surface less than the predetermined speed.

17. The varaiable tension controller of claim 1 wherien the underfeed and overfeed rollers are disposed parallel to one another.

18. The variable tension controller of claim 1 further comprising a tension adjustor operably coupled to the first strand positioner, said tension adjustor at least assisting in setting one of the first and second predetermined tension.

19. A variable tension controller comprising:

an overfeed roller having a strand engagement exterior surface;

an underfeed roller having a strand engagement exterior surface, said underfeed roller parallel to the overfeed roller and having a speed at a strand engagement exterior surface less than a speed at a strand engagement exterior surface of the overfeed roller;

a first strand positioner receiving a first strand at an input and directing the first strand to an output, said first strand positioner selectively applying the first strand to at least one of the overfeed and underfeed rollers and out of contact with the other of the overfeed and underfeed rollers when outside a predetermined tension range thereby providing a predetermined tension after output.

20. The variable tension controller of claim 19 wherein the input and the output are first and second guides respectively.

* * * * *